US010899142B2

(12) United States Patent
Amir et al.

(10) Patent No.: US 10,899,142 B2
(45) Date of Patent: Jan. 26, 2021

(54) DIGITAL PRINTING APPARATUS AND METHOD FOR PRINTING OF IRREGULAR SHAPED THREE DIMENSIONAL ITEMS

(71) Applicant: Kornit Digital Ltd., Rosh HaAyin (IL)

(72) Inventors: Nuriel Amir, Yokneam Ilit (IL); Ervin Fox, Gan-Yavne (IL)

(73) Assignee: Kornit Digital Ltd., Rosh HaAyin (IL)

( * ) Notice: Subject to any disclaimer, the term of this patent is extended or adjusted under 35 U.S.C. 154(b) by 89 days.

(21) Appl. No.: 16/203,677

(22) Filed: Nov. 29, 2018

(65) Prior Publication Data

US 2019/0160832 A1 May 30, 2019

Related U.S. Application Data

(60) Provisional application No. 62/591,828, filed on Nov. 29, 2017.

(51) Int. Cl.
*B41J 3/407* (2006.01)
*B41J 3/28* (2006.01)

(52) U.S. Cl.
CPC ..... *B41J 3/4073* (2013.01); *B41J 3/286* (2013.01); *B41J 3/407* (2013.01)

(58) Field of Classification Search
CPC ..... B41J 3/4073; B41J 3/407; B41J 3/286; A43D 95/14
See application file for complete search history.

(56) References Cited

U.S. PATENT DOCUMENTS 9,688,078 B1 * 6/2017 Irizarry ..... B41F 17/30
2016/0236483 A1 * 8/2016 Till ..... B41J 2/01

* cited by examiner

*Primary Examiner* — Henok D Legesse

(57) ABSTRACT

A printing apparatus for printing onto a surface of a previously made three-dimensional article consists of a printing head which is stationary in at least two dimensions, and a controllably movable holder that grips the article and moves the article around the printing head to present parts of the three dimensional possibly contoured surface in a printing order to a preset printing position under the printing head as the printing head prints onto said surface.

23 Claims, 4 Drawing Sheets

DIGITAL PRINTING APPARATUS AND METHOD FOR PRINTING OF IRREGULAR SHAPED THREE DIMENSIONAL ITEMS

RELATED APPLICATIONS

This application claims the benefit of priority under 35 USC § 119(e) of U.S. Provisional Patent Application No. 62/591,828 filed Nov. 29, 2017, the contents of which are incorporated herein by reference in their entirety.

FIELD AND BACKGROUND OF THE INVENTION

The present invention, in some embodiments thereof, relates to a digital printing apparatus and method for printing designs, patterns logos and the like on shaped surfaces and items and, more particularly, but not exclusively, to a digital printing apparatus that can print over a surface contoured in three dimensions.

In digital printing, droplets are emitted from nozzles onto the media surface, and a fixed distance, albeit with some tolerance, is needed between the media surface and the print head. Such a distance is necessary because otherwise the ink jet is impeded from exiting the print nozzle. The ink dries quickly and thus the nozzle may easily become blocked.

Maintenance of such a fixed distance is easy when the media is flat and has a smooth surface, such as on paper. The fixed distance is more difficult to maintain when printing on textiles, since textiles do not necessarily have smooth surfaces but a range solutions are available. In 3D printing, in which the printer deposits layers to form a 3D product, maintaining the requisite distance is carried out using the same computer aided design which defines the shape of the product being created. That is to say the printer knows at all times where the surface of the 3D product because it is creating that surface. The printing head is thus able to move correctly around the product being printed without the nozzles coming into contact with the surface and becoming blocked or contaminated.

However, printing a design, image, pattern, logo or other surface decoration onto a pre-existing three-dimensional object is more of a challenge. It is possible to pre-program a print path for a print head on the assumption that it is printing a series of objects that are identical, but if say a sequence of objects is not exactly the same, say there is a sequence of shoes of different sizes, then the program would have to be reformulated for every different shoe size.

Furthermore, if the object to be printed is of varying shape then a print head that moves has to be designed so that ink pressures and spray effectiveness do not change over any of the positions that the print head is likely to find itself in.

SUMMARY OF THE INVENTION

Embodiments of the invention may provide a printing apparatus and method in which an object to be printed is held and gripped. The object is then moved and rotated in the holder in three dimensions around a printer which is generally stationary or possibly moves in one dimension only.

The movement of the object and the holder may be controlled mechanically by a runner moving over a dummy object having a shape which is identical to the object being printed. Alternatively, a 3D profile of the object may be obtained, say from a Lidar scan of the object, and inserted into a computer aided design program, or an existing CAD profile may be used directly, and a movement sequence may be obtained to print the object.

According to an aspect of some embodiments of the present invention there is provided a printing apparatus for printing onto a surface of a previously made three-dimensional article, the apparatus comprising:

a printing head which is stationary in at least two dimensions;

a controllably movable holder configured to cause the article to be gripped and to move the article around the printing head to present parts of the surface in an order to the printing head while the printing head prints onto the surface.

In an embodiment, the printing head is an ink-jet printing head.

In an embodiment, the printing head is mobile in a depth direction towards and away from the article.

In an embodiment, the printing head is stationary in three dimensions.

In an embodiment, the apparatus further comprises a loading magazine comprising a plurality of the articles in a sequence.

In an embodiment, the loading magazine comprises pallets, each article of the sequence being mounted on a pallet and the holder being configured to pick a front pallet from the loader magazine.

In an embodiment, the moving holder is controlled by a runner that runs over a dummy article.

In an embodiment, the moving holder is controlled using a computer aided design (CAD) profile.

In an embodiment, the moving holder is controlled using a Lidar scan.

In an embodiment, succeeding articles are of different shapes and the holder is controlled to move differently with each article.

According to a second aspect of the present invention there is provided a method of printing onto a surface of a previously made three-dimensional article, the surface having a three-dimensional shape, the method comprising:

causing the previously made three-dimensional article to be gripped;

moving the article around the printing head to present parts of the surface having the three dimensional shape in an order to a printing head; and operating the printing head to print over the surface during the moving.

The method may comprise printing using a print file made for the three-dimensional shape.

The method may comprise printing using a print head which is mobile in a depth direction towards and away from the article.

The method may comprise printing using a print head which is stationary in three dimensions.

The method may comprise loading a plurality of the articles in a sequence for printing.

In an embodiment each article of the sequence is mounted on a pallet, and the method comprises picking a front pallet for printing.

The method may comprise controlling the moving using a runner that runs over a dummy article.

The method may comprise controlling the moving using a computer aided design (CAD) profile.

The method may comprise controlling the moving using a Lidar scan.

In embodiments, succeeding articles are of different shapes, and the motion is different for each article.

The method may comprise moving the article to present the surface to the print head in rows.

The method may comprise moving the article to keep the article at a preset printing distance from nozzles of the printing head.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention, in particular relating to control of the digital printer, and motion of the object during printing, can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
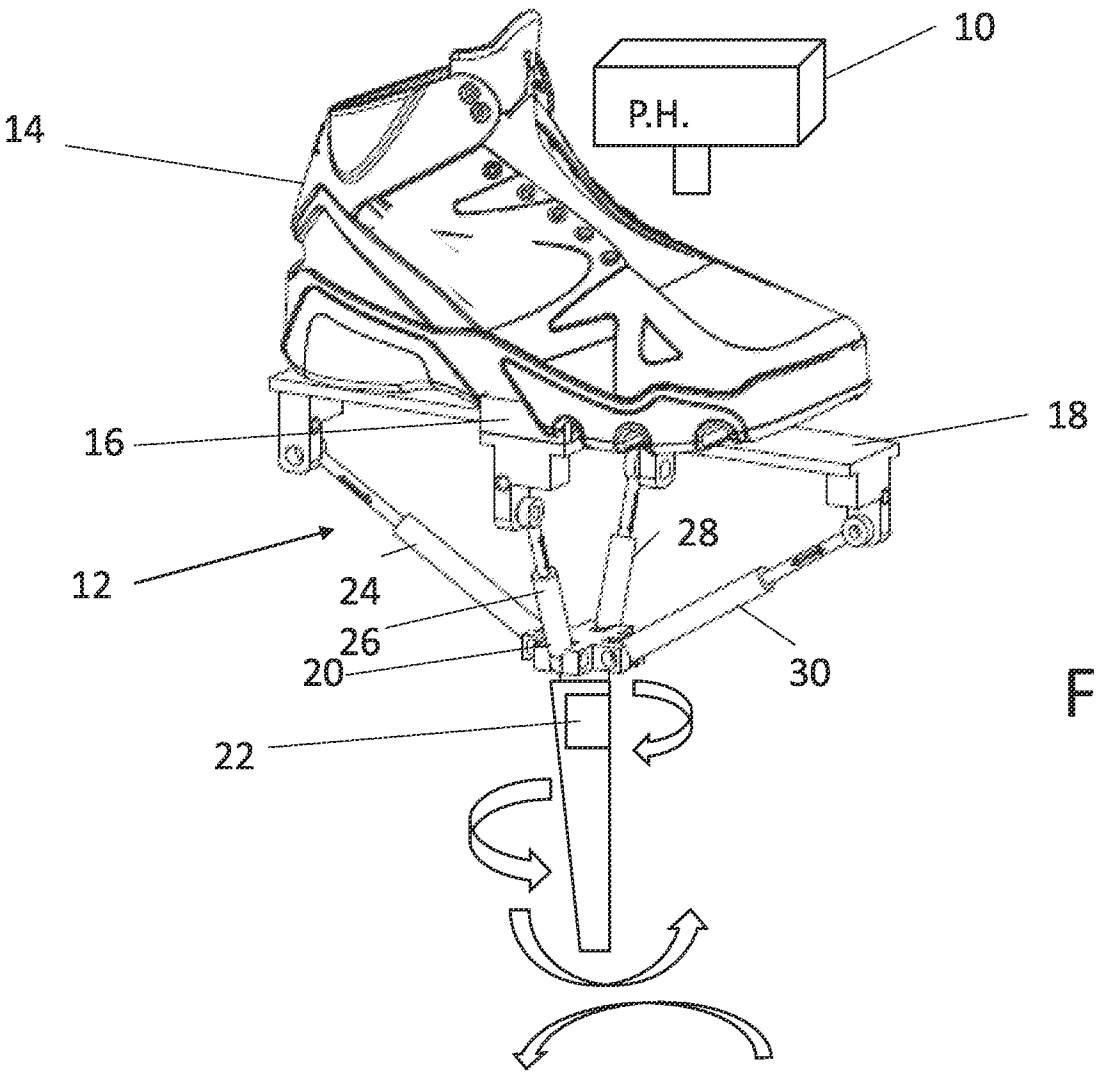
FIG. 1 is a simplified diagram showing a holder and printing head according to a first embodiment of the present invention.

The present invention, in some embodiments thereof, relates to a digital printing apparatus and method for irregular shaped items and, more particularly, but not exclusively, to a digital printing apparatus that can print over a surface contoured in three dimensions.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 illustrates a printing head 10 and a holder 12. The holder carries a previously made three-dimensional article, in this case shoe 14. The shoe is an irregularly shaped article having a surface that extends in three dimensions. Printing an image or design has challenges that do not apply when printing on a flat surface. As discussed in the background, it is desirable to keep a fixed distance between the printer nozzles and the surface being printed on and also the back pressure on the printing ink should be kept as constant as possible.

Printing head 10 is stationary in at least two dimensions, and in some embodiments is altogether stationary. Rather holder 12 moves in three dimensions to orientate each part of the surface of the article 14 towards the print head and then to pass the article at a constant distance from the print head.

In order to move the article in three dimensions the holder includes grips 16 which either grip the article directly or hold a pallet 18 that carries the article. The holder may include a joint 20, which is controlled by an actuator 22. The joint supports pallet 18 using telescoping arms 24, 26, 28 and 30, which may also be operated by actuators. Although four such arms are shown, embodiments may use three arms, or more than four arms, dependent on the movement precision required. The four arms are operated differentially to set the orientation of the pallet and therefore of the article. The system of joints is shown in greater detail in FIG. 2 discussed below.

By suitable control of the joints, the holder may move the article around the printing head in such a way as to present parts of the article surface to the printing head so that surface regions pass the printing head in a defined order to allow printing according to a print file. For example the article may pass the print head so that the print head sees the article in a sequence of rows. In order to do this the article may have to be rotated considerably so that the entire length of the row passes the print head substantially perpendicularly and at a preset distance, say 2 mm.

Printing is typically digital printing and may use an ink-jet printing head.

In some embodiments the print head is entirely stationary in all dimensions. In other embodiments the print head is able to move say towards and away from the article or able to move between articles that are at different printing positions. Thus a particular printing device may have several printing positions so that an item is always in position for printing and there is no downtime for loading.

Figure 2:
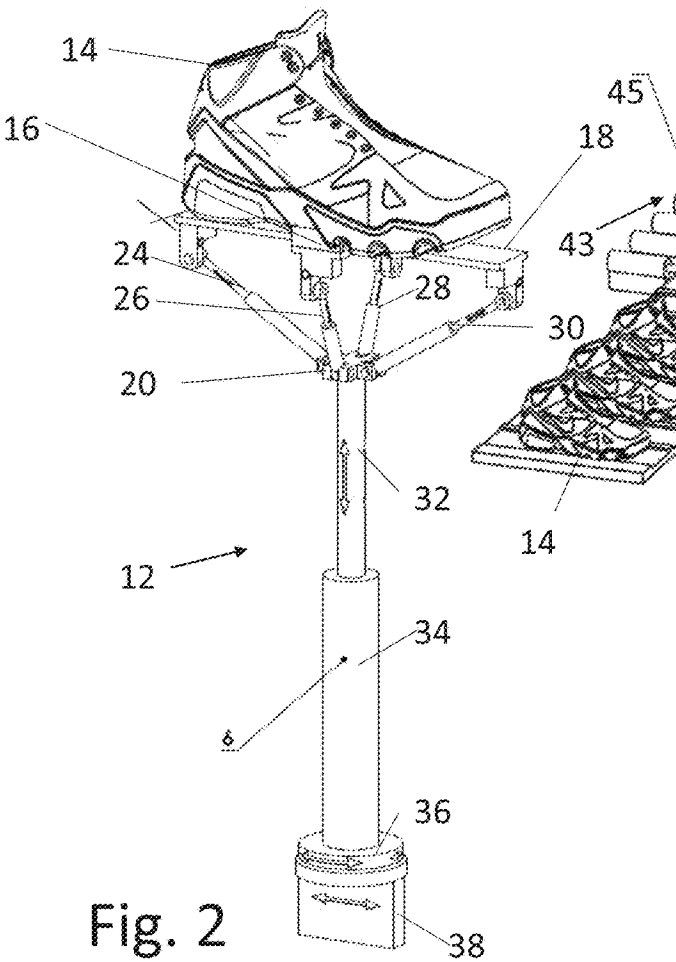
FIG. 2 is a simplified diagram showing the holder of FIG. 1 in greater detail.

Reference is now made to FIG. 2, which shows the holder 12 in greater detail. Parts that are the same as in FIG. 1 are given the same reference numerals and are not described again except as needed for an understanding of the present embodiment. As discussed, the holder 14 includes grips 16 which either grip the article directly or hold a pallet 18 that carries the article. The holder may include a joint 20, which is controlled by an actuator 22. The joint supports pallet 18 using telescoping arms 24, 26, 28 and 30, which are operated by the actuator. Joint 20 is supported by column 32 which telescopes in and out of column 34 to provide movement upwards and downwards. Column 34 is mounted on rotating connector 36 which allows for rotation of the holder in the horizontal plane. The rotary connector 36 is mounted in slider 38 which fits into a rail on the printer for linear movement around the printing apparatus.

Figure 3:
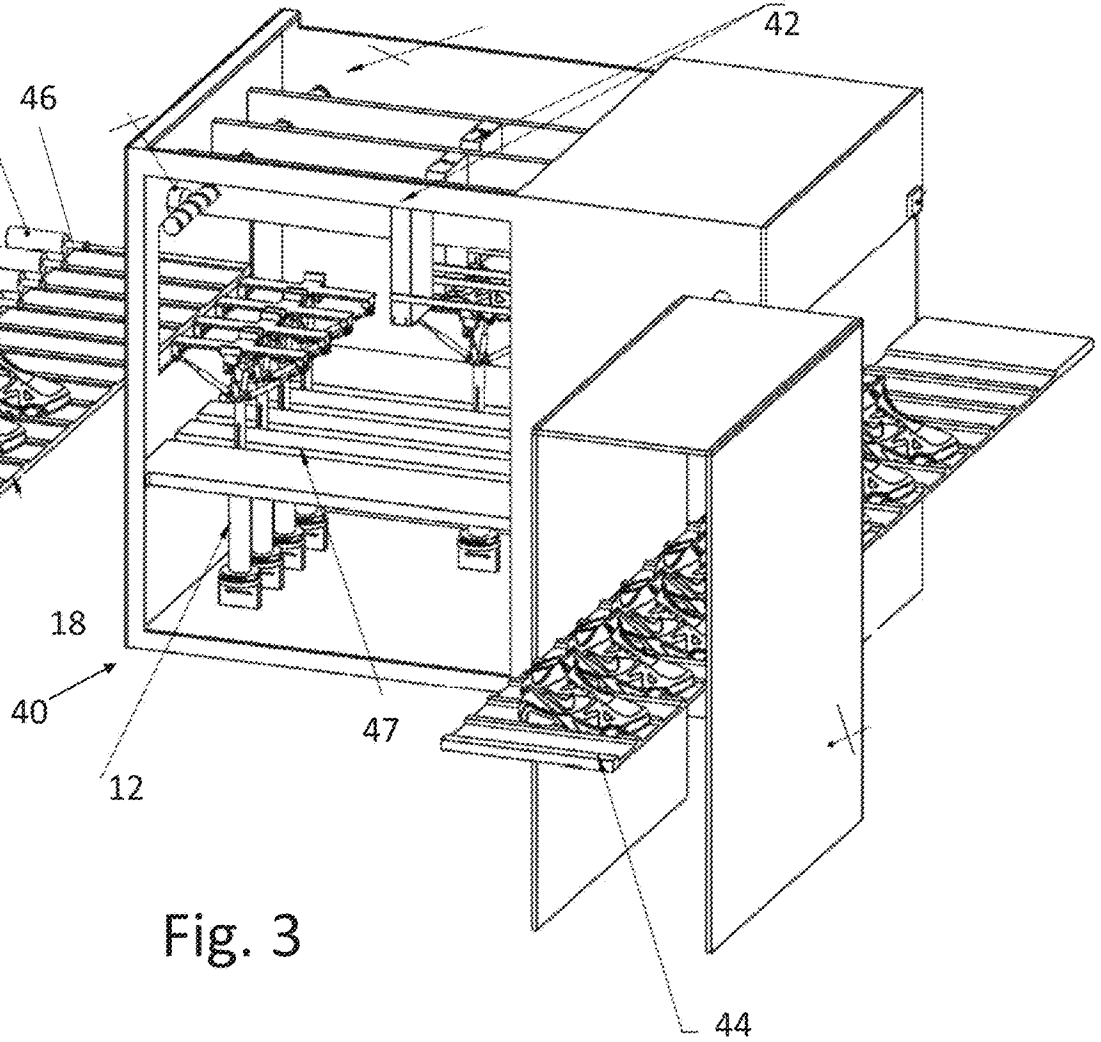
FIG. 3 is a simplified diagram showing a printing apparatus according to the present embodiments for printing on three-dimensional articles.

Reference is now made to FIG. 3, which is a simplified diagram showing a printing apparatus 40 for printing shoes or like articles according to embodiments of the present invention. On one side of the machine is a queue of articles to be printed in sequence, such as shoes 14. Each shoe is mounted on a sliding pallet 18. In an embodiment the queue of pallets forms a loading magazine. As the pallet gets to the front of the queue it is pushed onto one of the holders 12 by pusher 43. Pusher 43 includes a piston 45 and shaft 46, and the shaft pushes the shoe and pallet inwards into the machine, for example along tracks 47. Each holder is shaped to receive the pallet firmly within grips 16 as the pallet slides in under influence of pusher 43. The holders then slide one by one to printing position 42 in the middle of the machine where a print head—not visible in this figure—is positioned. The holder moves the surface of the shoe in a path that keeps it at a fixed distance from the print head and perpendicular to the print head at all points for printing. Finally the shoe, with the pattern, image, logo etc. printed thereon, is advanced to the output queue 44.

Figure 4:
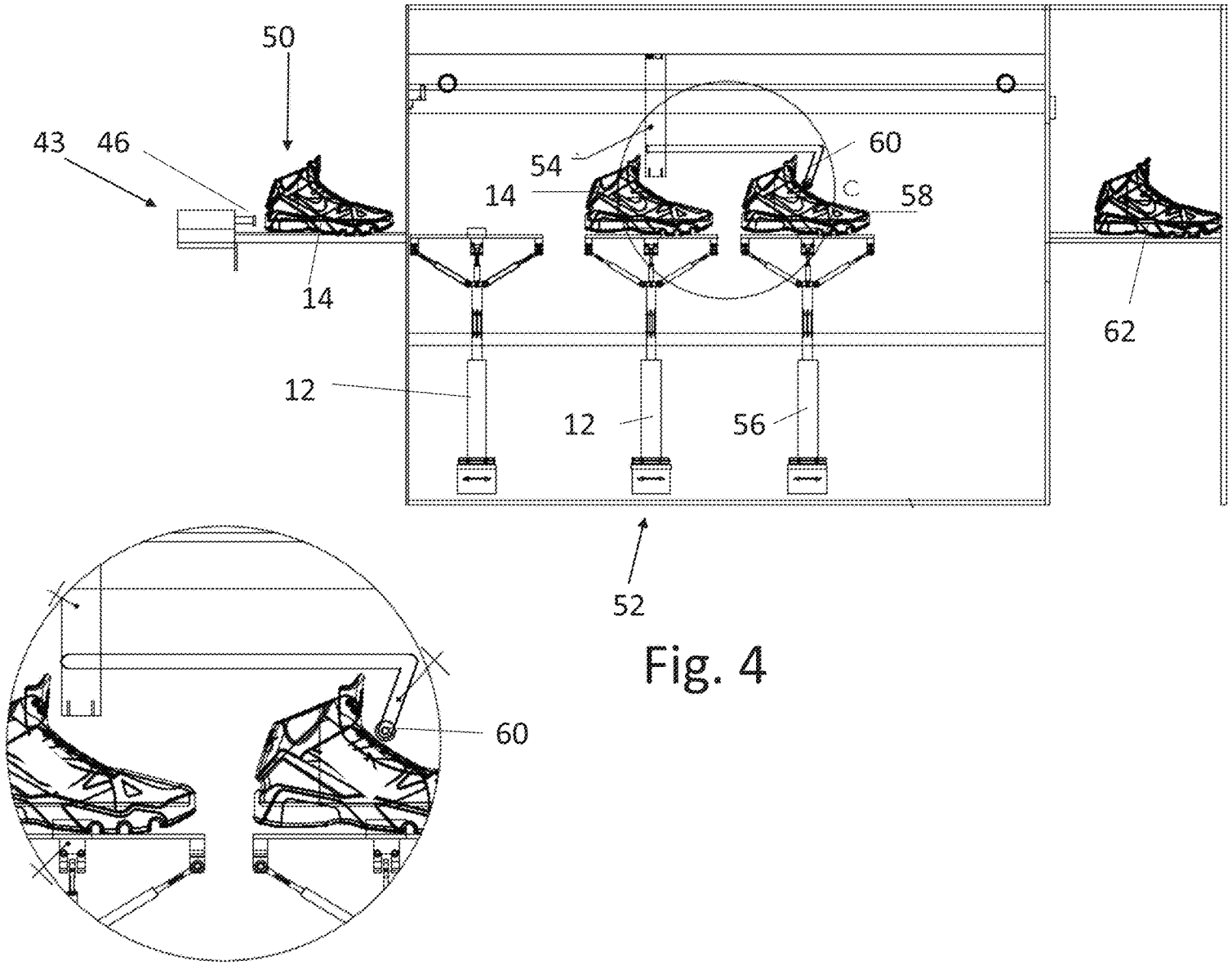
FIG. 4 is a simplified diagram showing a cross-section of the printing apparatus of FIG. 3 with a mechanical movement control arrangement.

Reference is now made to FIG. 4, which is a simplified diagram of a cross-sectional view of the printing machine 40 and showing a mechanical mechanism for controlling the motion of the holder 12. Shoe 14 arrives at input point 50 where it is pushed inwards by pusher 43 and shaft 46. The holder moves to print position 52 under print head 54. Next to the print position is a dummy holder 56 with a dummy or spare article 58 that is identical in shape to the article 14 being printed. A runner 60 runs over the dummy article along the row that is to be printed and the dummy holder maintains constant pressure so that the dummy article is held constantly against the roller. The real holder then mimics the movements of the dummy holder and the surface to be printed is kept at a constant distance from the print head. Finally the printed article exits to exit position 62.

As an alternative, the moving holder 52 may be controlled using a computer aided design (CAD) profile, or using a Lidar scan or any other suitable method. Succeeding articles may be of different shapes and sizes so that the holder may be controlled to move differently with each article. For example, in the case of shoes, there may be different sizes of the same design of shoe.

Figure 5:
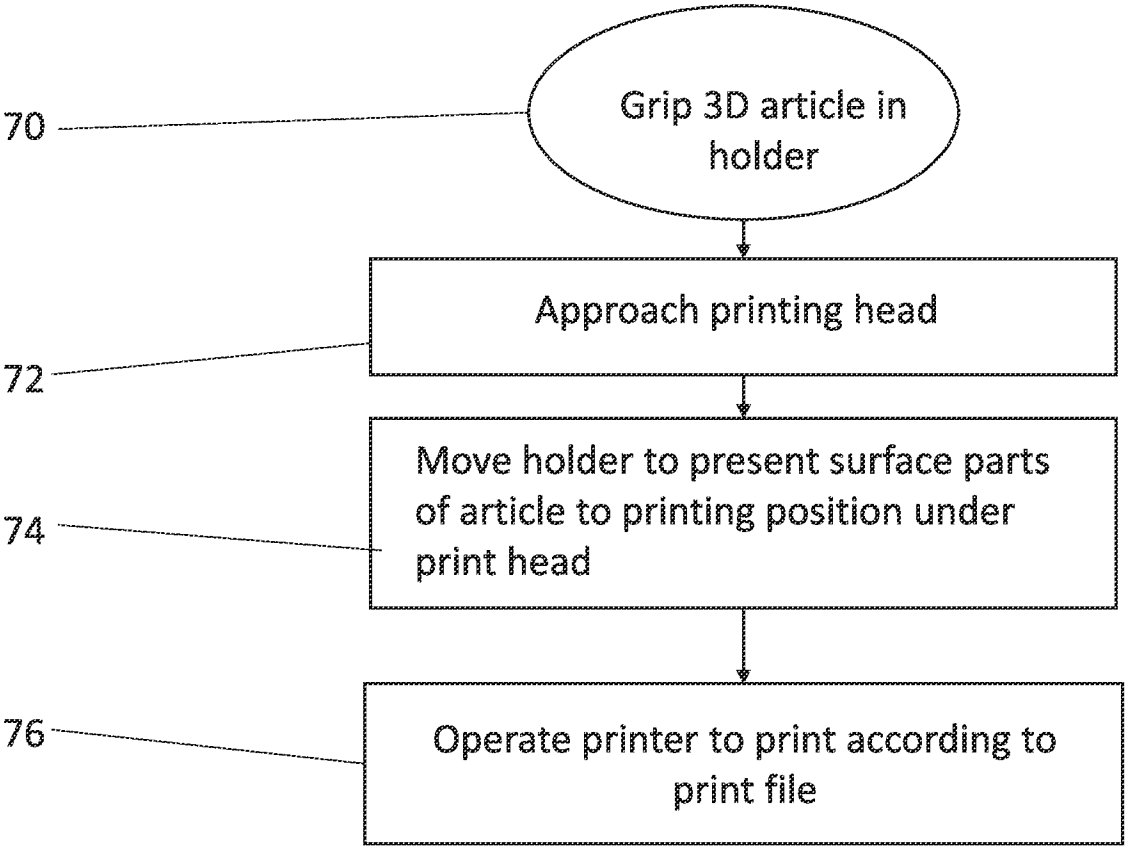
FIG. 5 is a simplified flow chart illustrating a printing operation according to the present embodiments.

Reference is now made to FIG. 5, which is a simplified flow chart of a printing operation for printing onto a surface of a previously made three-dimensional article. As discussed the article surface has a three-dimensional shape which may include contouring and positive and negative curvature. The article is gripped 70 in a holder and approaches the print head—72. At the print head the holder is moved—74—so that all surfaces of the article that are to printed are presented under the print head, ideally aligned to face the print head at ninety degrees as shown in the inset of FIG. 4. Each part is printed—76—typically according to a print file.

In order to enable printing according to a print file the surface parts may be presented to the print head in a preset order, typically as rows along the surface, and the print file may be constructed for the given three-dimensional shape and the intended path of the surface past the printer.

It is expected that during the life of a patent maturing from this application many relevant digital printing technologies and movement replication technologies will be developed and the scopes of the corresponding terms are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A printing apparatus for printing onto an irregular surface of a previously made irregularly shaped three-dimensional article, the apparatus comprising:

a printing head which is stationary in at least two dimensions;

a controllably movable holder configured to cause said irregularly shaped three-dimensional article to be gripped and to move said irregularly shaped three-dimensional article around said printing head to present parts of said irregular surface in an order to said printing head while said printing head prints onto said irregular surface, said controllably movable holder being configured to move said irregular object over a programmed path able to change orientation and height of said object during printing such that a part of said irregular surface being printed at a given time is held at a predetermined fixed distance from said printing head and is perpendicular to said printing head.

2. The printing apparatus of claim 1, wherein said printing head is an ink-jet printing head.

3. The printing apparatus of claim 1, wherein said printing head is mobile in a depth direction towards and away from said article.

4. The printing apparatus of claim 1, wherein said printing head is stationary in three dimensions.

5. The printing apparatus of claim 1, wherein said apparatus further comprises a loading magazine comprising a plurality of said articles in a sequence.

6. The printing apparatus of claim 5, wherein said loading magazine comprises pallets, each article of said sequence being mounted on a pallet and said holder being configured to pick a front pallet from said loader magazine.

7. The printing apparatus of claim 1 wherein said moving holder is controlled by a runner that runs over a dummy article.

8. The printing apparatus of claim 1, wherein said moving holder is controlled using a computer aided design (CAD) profile.

9. The printing apparatus of claim 1, wherein said moving holder is controlled using a Lidar scan.

10. The printing apparatus of claim 1, wherein succeeding articles are of different shapes and said holder is controlled to move differently with each article.

11. A method of printing onto a surface of a previously made irregularly shaped three-dimensional article, the surface having an irregular three-dimensional shape, the method comprising:

causing said previously made irregularly shaped three-dimensional article to be gripped;

moving said article around said printing head over a printing path able to change both height and orientation of said irregularly shaped three-dimensional article to present parts of said surface having said three dimensional shape in an order to a printing head said printing path ensuring that a part of said irregular surface being printed is held at a predetermined fixed distance from said printing head and is perpendicular to said printing head; and operating said printing head to print over said surface during said moving.

12. The method of claim 11, comprising printing using a print file made for said three-dimensional shape.

13. The method of claim 11, comprising printing using a print head which is mobile in a depth direction towards and away from said article.

14. The method of claim 11, comprising printing using a print head which is stationary in three dimensions.

15. The method of claim 11, comprising loading a plurality of said articles in a sequence for printing.

16. The method of claim 15, wherein each article of said sequence is mounted on a pallet, the method comprising picking a front pallet for printing.

17. The method of claim 11, comprising controlling said moving using a runner that runs over a dummy article.

18. The method of claim 11, comprising controlling said moving using a computer aided design (CAD) profile.

19. The method of claim 11, comprising controlling said moving using a Lidar scan.

20. The method of claim 11, wherein succeeding articles are of different shapes, said moving being different for each article.

21. The method of claim 11, comprising moving said article to present said surface to said print head in rows.

22. The method of claim 11, comprising moving said article to keep said article at a preset printing distance from nozzles of said printing head.

23. A printing apparatus for printing onto an irregular surface of a previously made irregularly shaped three-dimensional article, the apparatus comprising:

a printing head which is stationary in at least two dimensions;

a controllably movable holder configured to cause said irregularly shaped three-dimensional article to be gripped and to move said irregularly shaped three-dimensional article around said printing head to present parts of said irregular surface in an order to said printing head while said printing head prints onto said irregular surface, said controllably movable holder being configured with a plurality of separately actuatable arms to change orientation and height of said object relative to said printing head, thereby to enable movement of said irregular object over a programmed path such that a part of said irregular surface being printed is held at a predetermined fixed distance from said printing head and is perpendicular to said printing head.

* * * * *